United States Patent [19]

de Jong et al.

[11] 4,198,586

[45] Apr. 15, 1980

[54] HIGH PRESSURE METAL VAPOR DISCHARGE LAMP AND SEAL STRUCTURE THEREFOR

[75] Inventors: Jacobus de Jong; Gerardus A. P. M. Cornelissen, both of Eindhoven, Netherlands

[73] Assignee: U.S. Philips Corporation, New York, N.Y.

[21] Appl. No.: 893,674

[22] Filed: Apr. 5, 1978

[30] Foreign Application Priority Data

Apr. 15, 1977 [NL] Netherlands ..... 7704135

[51] Int. Cl.[2] ..... H01J 61/36

[52] U.S. Cl. ..... 313/220

[58] Field of Search ..... 313/220

[56] References Cited

U.S. PATENT DOCUMENTS

| | | | |
|---|---|---|---|
| 3,363,134 | 1/1968 | Johnson | 313/220 |
| 3,450,924 | 6/1969 | Knochel et al. | 313/220 |
| 3,564,328 | 2/1971 | Bagley | 313/220 |
| 3,609,437 | 9/1971 | De Vrijer et al. | 313/220 |
| 3,726,582 | 4/1973 | Tol et al. | 313/220 X |
| 3,825,788 | 7/1974 | Pfaue et al. | 313/220 X |
| 4,052,635 | 10/1977 | Jacobs | 313/220 X |

*Primary Examiner*—Palmer C. Demeo

*Attorney, Agent, or Firm*—Robert S. Smith

[57] ABSTRACT

A high-pressure metal vapor discharge lamp having a ceramic discharge vessel, the end plug being fused by means of sintering to the discharge vessel slightly displaced inwards, sealing glass being disposed in the space enclosed by the end plug, the upright edge of the discharge vessel and the current supply element.

1 Claim, 1 Drawing Figure

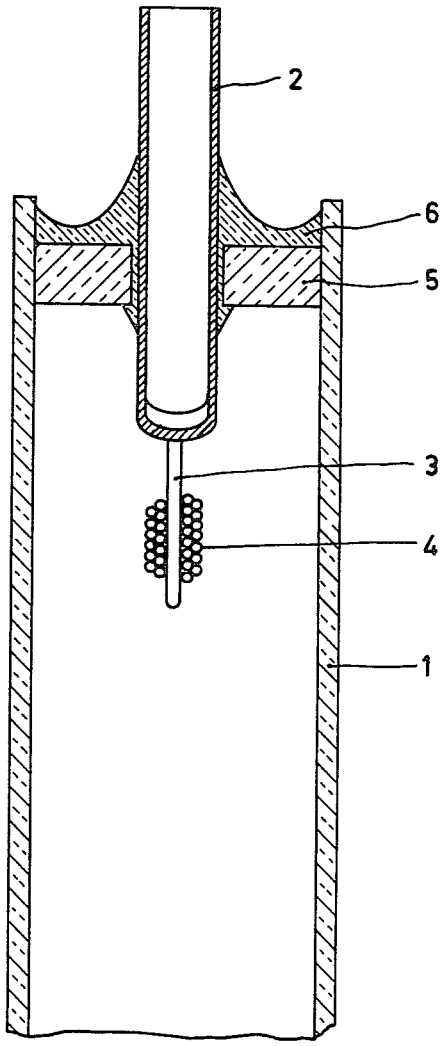
2
6
5
3
4
1

HIGH PRESSURE METAL VAPOR DISCHARGE LAMP AND SEAL STRUCTURE THEREFOR

The invention relates to a high pressure metal vapour discharge lamp having a ceramic vessel provided at at least one end with a ceramic end plug having an electrode current supply element extending therethrough, the end plug being displaced slightly inwards from the end of the discharge vessel and fused to the inner wall of the discharge vessel by means of sintering. German Auslegeschrift 1,923,138 discloses such a lamp.

With discharge lamps having a high operating temperature (for example 1000° C. or higher) the discharge vessel consists of ceramic material which will be understood herein to mean a polycrystalline material such as transparent gas-tight aluminium oxide as well as a monocrystalline material, such as sapphire.

In a lamp described in the above-mentioned Auslegeschrift the current supply element is fused, by means of a very small quantity of fusing material, in the inwardly displaced which has been sintered to the vessel ceramic end plug. Although the manner described in the Auslegeschrift results in a satisfactory seal between end plug and discharge vessel wall, the risk nevertheless exists that during operation of the lamp as gas leak occurs along the sintered seam of the end plug and the inner wall of the discharge vessel. Such a gas leak results in a premature failure of the lamp.

It is an object of the invention to provide a lamp construction in which this risk is at least reduced.

A high-pressure metal vapor discharge lamp of the type mentioned in the preamble is according to the invention characterized in that a glass seal extends across (1) the space intermediate the current supply element and an axial portion of the vessel which projects axially beyond the end plug. The glass seal further extends, at least in the region of the joint between the end plug and the current supply element the glass seal extends away from the discharge vessel further than the axial extremity of the vessel.

By applying sealing glass near the portion of above-said space located near the sintered seam of the end plug and the inner wall, the chance that gasleaks are produced along this sintered seam is greatly reduced. In general the entire space between the wall, the end plug and the current supply element is filled with sealing glass, the current supply element consisting for example of a tube or a solid rod of nobium is also connected in gas-tight manner by applying sealing glass between the outer surface of the current supply element and the end plug. In view of the construction according to the invention the application of a ceramic sealing ring at the outside of the end plug to prevent any gas leaks along the sintered seam is superfluous. Applying such an additional sealing ring during fabrication of the lamp is time-consuming and expensive.

A construction according to the invention can be used very advantageous with discharge vessels of a relatively small diameter (for example an inside diameter of approximately 5 mm), wherein the space between the outer surface of the current supply element and the inner wall of the discharge vessel is narrow. The sealing glass will flow, as a result of the capillary action very quickly between said walls over the end plug so that a proper seal is obtained.

The invention can be applied in various kinds of high-pressure metal vapor discharge lamps having a ceramic discharge vessel, such as high-pressure mercury vapour discharge lamps and high-pressure sodium vapor discharge lamps.

An embodiment of the invention will now be further explained with reference to the drawing which shows a longitudinal cross section of one end of a discharge vessel of a high-pressure sodium vapour discharge lamp according to the invention.

In the drawing the discharge vessel, whose wall consists of densely sintered aluminium oxide, is indicated by 1.

This discharge vessel has an outside diameter of approximately 9 mm and an inside diameter of approximately 7 mm. A tubular current supply conductor 2, whose diameter is approximately 4 mm, is shown at the end of the discharge vessel. An electrode pin 3 of tungsten is fitted to the end of conductor 2 located within the discharge vessel of the niobium tube by means of titanium solder (not shown). This pin is provided with an electron-emissive element 4 comprising a double layer of tungsten wire provided with electron-emitting material between the turns thereof. The current supply conductor 2 is disposed in an end plug 5, consisting of densely sintered aluminium-oxide, which is displaced approximately 0.5 mm inwards from the end of the discharge vessel and fused to the inner surface of the discharge vessel by means of sintering. The space between the end plug 5 and the feedthrough 2, and the space limited by the feedthrough 2, the end plug 5 and the inner surface of the end edge of the discharge vessel projecting beyond plug 5 is filled with a glass seal 6 consisting of a mixture of oxides, mainly aluminum oxide, calcium oxide, barium oxide and magnesium oxide. The discharge vessel 1 contains 25 mg of an amalgam of sodium and mercury and also xenon, as starting gas, at a pressure of approximately 30 Torr. In general the discharge vessel is used in a glass outer bulb (not shown in the drawing). At a power consumption of 400 Watt the total luminous efficiency of such a lamp amounts to 50000 Lumens.

We claim:

1. A high-pressure metal vapor discharge lamp having an elongated ceramic discharge tube which is provided at at least one end with a ceramic end plug having an electrode current supply element extending therethrough, said end plug being axially displaced inward from the end of the discharge tube and fused to the inner wall of the discharge tube by means of sintering, said lamp further including a glass seal disposed in the annular space intermediate said current supply element and said discharge tube and adjacent to said end plug and which glass seal projects axially beyond the axial extremity of said discharge tube at least in the region of the joint between said end plug and said current supply element, said lamp having no member covering said glass seal which extends between said plug and said tube.

* * * * *